United States Patent [19]

Mundloch et al.

[11] Patent Number: 4,805,540

[45] Date of Patent: Feb. 21, 1989

[54] CENTER STUB STILL RAILWAY TANK CAR CONSTRUCTION

[75] Inventors: James D. Mundloch, St. Louis County; William U. Casseau, St. Louis, both of Mo.

[73] Assignee: ACF Industries, Incorporated, Earth City, Mo.

[21] Appl. No.: 866,693

[22] Filed: Jul. 14, 1986

[51] Int. Cl.[4] ..... B61D 5/00

[52] U.S. Cl. ..... 105/358; 105/360; 105/362

[58] Field of Search ..... 105/358, 360, 362, 416, 105/414, 413, 451

[56] References Cited

U.S. PATENT DOCUMENTS

| | | | |
|---|---|---|---|
| 857,571 | 6/1907 | Ames | 105/362 |
| 1,237,156 | 8/1917 | Becker | 105/362 |
| 1,394,956 | 10/1921 | Weaver | 105/362 |
| 3,467,027 | 9/1969 | Brown | 105/362 |
| 3,685,458 | 8/1972 | Price et al. | 105/360 X |
| 4,515,189 | 5/1985 | Mowatt-Larsen | 195/358 X |
| 4,594,948 | 6/1986 | Smith et al. | 105/360 X |
| 4,608,931 | 9/1986 | Ruhmann et al. | 105/358 X |

*Primary Examiner*—Kenneth J. Dorner
*Assistant Examiner*—Laurie K. Cranmer
*Attorney, Agent, or Firm*—Polster, Polster and Lucchesi

[57] ABSTRACT

A center stub sill railway tank car is disclosed having a generally cylindric, elongate tank. A center stub sill assembly is secured to the lower portion of the tank at each end thereof for transferring longitudinal train and lading loads between the tank and the center stub sill assembly. A bolster assembly is secured to the center stub sill and extends transversely of the car. An improved cradle assembly is secured to the lower end portion of the tank for reinforcing the tank bottom in the area of the center stub sill, the cradle assembly having an arcuate cradle extending at least in part circumferentially upwardly from the bottom centerline of the tank generally at the longitudinal position of the bolster assembly, and an upwardly facing hat section elongate cradle secured to the bottom end of the tank and extending inboard from the cradle. The center stub sill has vertical flanges extending inwardly from the bolster assembly on the outside of the hat section shaped cradle pad and welded thereto so as to transmit loading between the cradle pad and the center stub sill assembly.

11 Claims, 4 Drawing Sheets

CENTER STUB STILL RAILWAY TANK CAR CONSTRUCTION

BACKGROUND OF THE INVENTION

This invention relates to a center stub still railway tank car, and more specifically to the construction car ends, and even more particularly to the construction of the center stub sill and the cradle assembly which is utilized to join the tank of a railway tank car to the center stub sill assembly.

Center stub sill railway tank cars, for carrying a variety of liquid, gaseous, and semi-liquid ladings, are known in which a horizontal, generally cylindrical tank is utilized not only as a tank to hold the lading, but also as the primary structure for the railway car to carry longitudinal train loads and lading loads. Conventionally, as shown in FIG. 2 herein and as will be hereinafter described in detail, prior art center stub sill railway tank cars had an elongate stub sill assembly secured to each bottom end of the tank, with the stub sill assembly carrying a coupler at its outer end and having a truck assembly pivotally connected thereto for rollingly supporting one end of the tank car on the rails. Typically, a cradle assembly was provided at each end of the car with the cradle assembly comprising a circumferential cradle extending arcuately up from the bottom center of the car, and a cradle pad extending inboard (i.e., toward the center of the car) from the circumferential cradle. Both the cradle and the cradle pad were of steel plate construction and were formed to conform to and to fit on the outer surface of the cylindric tank. Both the cradle and the cradle pad were welded all around their respective peripheries to the outside of the tank, except in certain areas which were inaccessible for welding.

The center stub sill was generally formed of two hot rolled steel Z-shaped sections seam welded along their upper longitudinal centerline so that in cross section, the center stub sill appeared to be a downwardly facing channel-shaped member having lower, outwardly extending feet, a pair of spaced vertical side flanges, and a horizontal top sill member. The center stub sill assembly carried a downwardly facing center plate which permitted the truck assembly to be pivotally attached to the stub sill assembly. The center stub sill and the end of the car were reinforced by a transversely extending bolster assembly welded to the stub sill and to the circumferential pad. Inboard of the outermost edge of the cradle pad, the top web of the center stub sill assembly was cut away such that only the spaced vertical flanges of the stub sill extended inwardly from the outermost edge of the bolster pad. The upper edges of these sill flanges contacted the bottom face of the cradle pad, and the sill flanges were welded to the cradle pad.

Because the center stub sill assembly and the coupler carried thereby were located somewhat below the level of the bottom of the tank (about 8–12 inches below the bottom of the tank), and because the cylindrical tank structure carried the longitudinal train loads axially of the car, an offset or moment arm between the tank structure and the centerline of the coupler was present. This offset resulted in a significant overturning moment being induced in the center stub sill and in the end portion of the tank such that the end of the tank and the center stub sill assembly must withstand these overturning moments. It will be appreciated that the longitudinal train loads that the car is required to withstand, in accordance with the American Association of Railroads (AAR), is a dynamic or impact load of 1,250,000 pounds and a static squeeze of compression load of about 1,000,000 pounds. Because of the vertical offset and the magnitude of the loads, the overturning moments are very significant.

Additionally, the above-noted overturning moments force the inboard end of the center stub sill assembly to apply relatively high, localized loading to the bottom of the tank such that even though the bottom of the tank was structurally reinforced by the plate-like cradle pad proximate the inboard ends of the center stub sill, an additional cradle pad reinforcement plate was required so as to prevent localized buckling of the cradle pad and the tank.

Further, it is conventional to provide an exterior heater coil system on many tank cars in which half-oval steam lines are welded to the exterior surface of the tank in an elongate, serpentine fashion so as to extend lengthwise of the tank substantially from one end thereof to the other, and to extend up the sides of the tank to about mid-level of the tank. For unloading certain ladings such as heavy petroleum oils, molten sulphur, tallow, lard, and other ladings which may congeal during shipping and which may need to be heated for ease in unloading via a bottom outlet valve, a train attendant, upon unloading of the car, would connect a steam line to the exterior heater coil system provided on the car such that live steam could be circulated through the steam lines thereby to heat the lading within the tank car.

In the design of such a heater coil system, it is desirable that the bottom centerline of the car be heated so as to ensure that all of the lading within the car may be readily off-loaded by means of the bottom outlet valve. It is also important in most exterior heater coil systems that the end of the serpentine heater coils extend outboard as far as possible so as to heat the lading at the ends of the tank car.

In prior art tank car constructions, as heretofore described, it oftentimes was necessary, as shown in FIG. 2 herein, for the serpentine steam coils to extend through the bolster web and to overlie the circumferential cradle so as to heat the ends of the tank. In order to overlie the circumferential cradle, it was necessary to provide a joggle in the steam coils which was difficult and expensive to fabricate, and which required additional labor. Likewise, the provision of cutouts in the bolster web required additional fabrication and labor, and it was also necessary to ensure that the cutouts for the steam coils in the bolster web were structural cutouts such that the load carrying capability of the bolster web was not adversely affected.

Still further, with a longitudinal cradle pad conforming to and welded to the bottom center of the tank, it was difficult to effectively heat the bottom portion of the tank covered by the cradle pad. If a heater coil were mounted on the bottom centerline of the car, it must overlie the longitudinal cradle pad and be separated from the interior of the tank by both the thickness of the tank wall and by the thickness of the cradle pad. This oftentimes could mean as much as three-fourths inch of steel or more with an effective thermal conduction barrier at the interface between the longitudinal cradle pad and the tank substantially reduced heat transfer from this steam coil in heat transfer relation with the cradle pad. Additionally, the cradle reinforcement pad proximate the ends of the center stub sill, as heretofore described, even further interfered with a bottom centerline steam coil.

Still further, in the construction of prior art center stub sill railway tank cars utilizing hot rolled Z-section center stub sills, it was a relatively difficult and labor intensive task to weld the center stub sill weldment to the cradle assembly. Since the center stub sill member was typically made by butt seam welding the upper flanges of two Z-sections together along the entire length of the stub sill during fabrication thereof, it was necessary to cut away the upper web of the center sill in the area inboard of the outermost edge of the cradle so that the stub sill vertical flanges could be welded to the cradle pad inboard of the cradle pad. The necessity of cutting away the top web of the center sill required extensive labor and resulted in significant material waste. Additionally, because the center stub sill, bolster assembly, and cradle assembly are welded together as a single weldment, it was a relatively difficult task to fit the cradle pad to the cylindric tank.

Further, in the securement of the bolster assembly to the center stub sill and to the cradle, there were a number of structural steel plates installed within the center sill, such as center filler spacers and the like, which were difficult to fit and to weld. There were also areas between the backstop brace and the cradle pad which did not have sufficient access such that the cradle could be readily welded to the tank, and thus it was necessary to omit the weld from these areas. To compensate for this inability to weld, it was oftentimes necessary to provide additional structure or slot welds which increased weight and cost of the stub sill assembly. Still further, outboard of the bolster assembly, on opposite sides of the center stub sill, it was oftentimes necessary to provide sill reinforcing bars on opposite sides of the sill which extended longitudinally of the sill for a distance of approximately three feet or so (1 m.). These sill reinforcing bars provided additional tension and compression load carrying capability outboard of the bolster assembly for the center stub sill, but increased the cost and weight of the assembly.

With prior art cradle assemblies utilizing a cradle pad or plate conformed in transverse direction to the cylindric shape of the tank welded around its periphery to the tank bottom, it will be appreciated that it was a difficult task to conform the cradle pad to the cylindric surface of the tank. This is due to the fact that the pad has a length of approximately 12–13 feet and a width of about 3 feet, and the cradle, center stub sill and bolster are welded into a rigid weldment before it is welded to the tank.

It was also recognized that weld terminations of the prior art railway car, such as is illustrated in FIG. 2, in the region of the bolster, posed a load transfer problem in the center stub sill construction where longitudinal and vertical loads were reacted at their respective weld terminations. It is desirable to prevent the longitudinal and vertical loads from being reacted at their weld terminations. However, with the prior art center stub sill and cradle pad design, it was, in many cases, nevertheless necessary to react these loads at their weld terminations.

SUMMARY OF THE INVENTION

Among the several objects and features of the present invention may be noted the provision of an improved center stub sill railway tank car which provides for a slip-fit between the inboard ends of the center stub sill and the cradle pad thereby simplifying manufacturing procedures and welding conditions;

The provision of such a center stub sill railway car construction in which the load paths for transferring longitudinal train loads and overturning moments between the center stub sill and the tank body are improved and are more efficient;

The provision of such a center stub sill railway car construction which enables weld fabrication sequences which in turn facilitates welding of the various structural components of the center stub sill, the bolster assembly, and the cradle pad so as to result in savings of labor and material and so as to result in a more efficient load path between the center stub sill and the cradle assembly;

The provision of such a center stub sill railway car construction in which the reaction of loads into the tank structure is more efficient;

The provision of such a center stub sill railway car construction which allows external coils to be placed at the bottom center of the tank in direct heat transfer relation with the tank without an intermediate thickness of metal between the external steam coil and the tank wall thereby to increase heat transfer from the coils to the tank;

The provision of such a center stub sill railway car construction which permits a steam line mounted directly on the bottom centerline of the tank and to extend outwardly beyond the bolster assembly without the necessity of having to cut the top web of the center stub sill;

The provision of such a center stub sill railway car construction in which the moment arm from the striker to the plane of the bolster assembly is shortened thereby to lessen vertical loads imposed on or transferred between the center stub sill and the tank end;

The provision of such a center stub sill railway car construction in which the cradle pad may be readily conformed to the tank and welded thereto;

The provision of such a center stub sill railway car construction which eliminates the necessity of reinforcement scab plates adjacent the inboard ends of the center stub sill for preventing local buckling of the cradle pad and the tank; and The provision of such a center stub sill railway car construction which efficiently uses materials, which has improved load and moment transfer paths, which permits the use of either rolled Z-section center sill construction or fabricated center sill construction, which is of rugged and durable construction, and which has a long service life.

Other objects and features of this invention will be in part apparent and in part pointed out hereinafter.

Briefly stated, this invention relates to a center stub sill railway car, and more particularly to a tank car having a generally cylindric, elongate tank, with a tank end at each end thereof. A center stub sill assembly is secured to the lower portion of the tank at each end of the tank for transferring longitudinal train loads and lading loads between the tank and the center stub sill assembly. Each center stub sill assembly carries a coupler, and a truck assembly is pivotally connected to the center stub sill assembly for rollingly supporting the railway car on the rails. The center stub sill assembly comprises a center stub sill secured to the bottom portion of the tank and extending inboard (i.e., toward the center of the tank car), but terminating short of the center of the tank, and extending outboard beyond the end of the tank for carrying a coupler. A bolster assembly is secured to the center stub sill assembly so as to extend transversely thereof proximate the connection of the truck assembly to the center stub sill assembly. Further, a cradle assembly is secured to the lower end portions of the tank at each end thereof for reinforcing the tank bottom and for transferring loads between the tank and the center stub sill assembly. Specifically, an improved cradle assembly is provided having an arcuate cradle extending circumferentially upwardly from the bottom of the tank somewhat inboard of the transition between the tank end and the tank generally at the longitudinal position of the bolster assembly. The cradle assembly further comprises an upwardly facing hat shaped elongate cradle secured to the bottom of the tank and extending inboard from the cradle. The hat shaped cradle has a lower center web spaced below the bottom center of the tank and flanges extending upwardly from the center web and being secured to the tank on opposite sides of the bottom centerline of the tank. The center stub sill assembly comprises a downwardly facing channel-shaped member extending inboard from the coupler and having an upper horizontal sill web adjacent the bottom of the tank extending in inboard direction from the outer end of the center sill proximate the bolster assembly, and a pair of sill flanges extending downwardly from the horizontal sill web with the vertical sill flanges being disposed on the outer faces of the hat shaped cradle flanges for rigid securement thereto.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
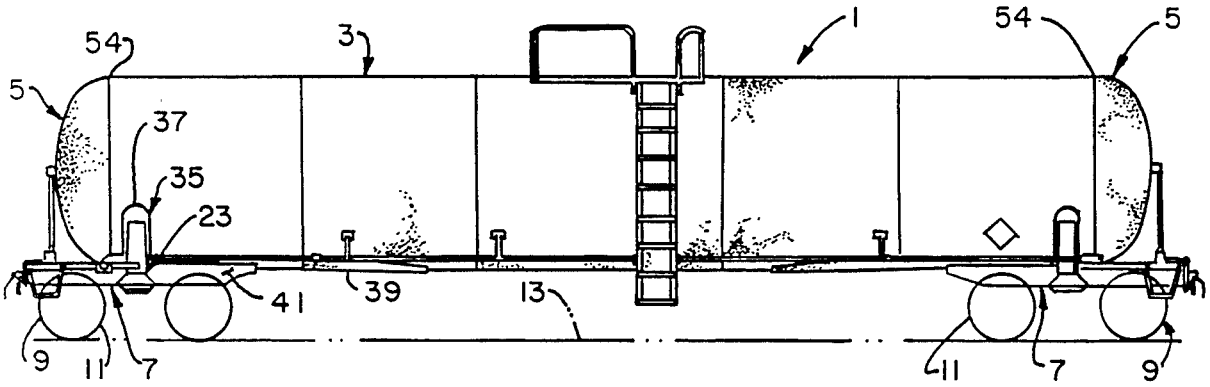
FIG. 1. PRIOR ART.
FIG. 1 a side elevational view of a prior art railway tank car having at each end thereof a center stub sill assembly, a truck assembly, and a cradle for reinforcing the bottom lower portions of the tank and for transferring loads between the center stub sill assembly and the tank at each end thereof.
Figure 2:
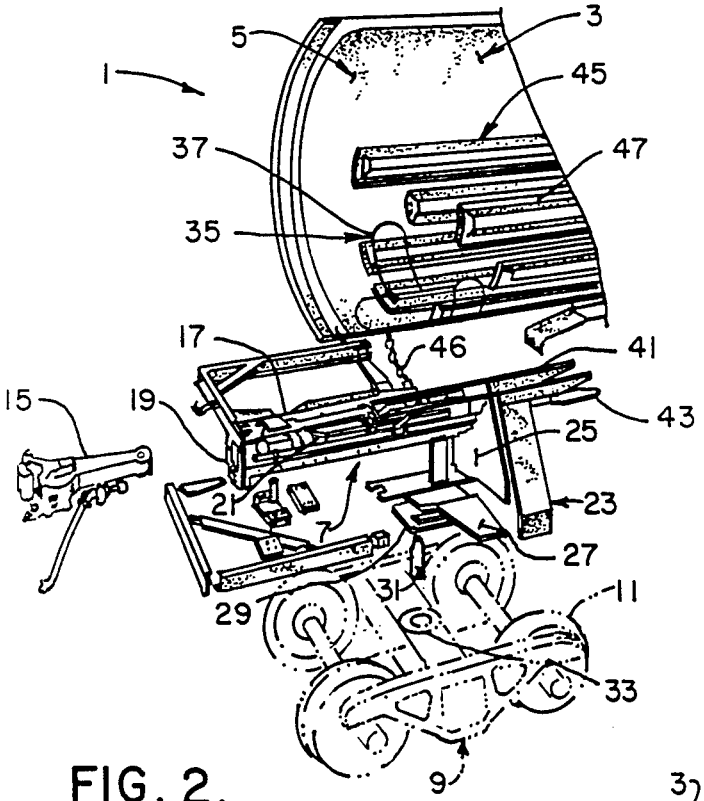
FIG. 2. PRIOR ART
FIG. 2 is an exploded perspective view with certain parts broken away for purposes of clarity, illustrating the construction of prior art center stub sill assembly and cradle.
Figure 4:
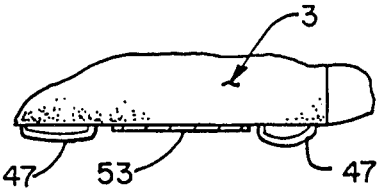
FIG. 4 is a cross sectional view taken along line 4—4 of FIG. 3.

Referring now to the drawings, and more specifically to FIGS. 1 and 2, a prior art center stub sill railway tank car is indicated in its entirety by reference character 1. More specifically, tank car 1 is shown to comprise an elongate, horizontal, cylindric tank or body 3 having domed tank ends 5 at each end thereof. As is typical, tank 3 and tank ends 5 are made of formed steel plate welded construction. Tank 3 serves not only to hold a liquid or semi-liquid lading, but also serves to transmit longitudinal train loads from one end of the car to the other.

At each end of tank car 1, a center stub sill assembly, as generally indicated at 7, is provided, and a truck assembly 9 is pivotally mounted to each respective center stub sill assembly for rollingly supporting the tank car by means of wheels 11 on rails 13.

Each center stub sill assembly 7 carries a coupler 15 for coupling tank car 1 to other railway cars in a train in the conventional manner. The center stub sill assembly comprises a stub sill 17 of generally downwardly facing channel-shaped construction. The center stub sill 17 has a striker 19 at its outer end and draft gear 21 is carried for connection of coupler 15 to the center stub sill 17 and for cushioning the coupler relative to the center stub sill.

A bolster assembly, as generally indicated at 23, extends transversely of the railway car inboard of tank end 5 for supporting tank 3 in transverse direction relative to the center stub sill assembly 7. Specifically, bolster assembly 23 includes a vertically disposed bolster web 25 having a bolster bottom cover or flange 27 welded thereto. A body center plate 29 is secured to the bolster assembly 23 and to the center stub sill assembly 7 at the center of the car and the truck assembly 9 is pivotally secured to the center body plate 29 by a center pin 31, with the body center plate 29 slidingly engaging a center truck bearing 33 formed in the upper surface of the truck 9.

As can be appreciated, with center stub sill assembly 7 carrying coupler 15 being located below the bottom centerline of tank 3, and with the tank carrying the longitudinal train loads and lading loads from one center stub sill assembly at one end of the car to another center stub sill assembly at the other end of the car, the vertical offset between the longitudinal centerline of coupler 15 and the load path extending through the bottom portion of tank 3 creates a substantial overturning moment which must be reacted by the lower end portions of tank 3, and by the center stub sill assembly. Typically, the longitudinal train loads are quite high (e.g., dynamic loads of 1,250,000 pounds and static squeeze loads of 1,000,000 pounds), and the vertical offset between the centerline of coupler 15 and the bottom of the tank may range between about 8–12 inches. This would imply that the overturning moments which the center stub sill assembly and the lower portions of tank 3 must withstand may range between about 667,000–1,250,000 foot-pounds.

In order to locally reinforce the bottom end portions of tank 3, a tank cradle assembly, as generally indicated at 35, is secured (welded) to the bottom portions of tank 3 generally in the local areas of the tank contacted by the center stub sill assembly 7 and by the bolster assembly 23. More specifically, in prior art railway tank cars, as shown in FIGS. 1 and 2, the cradle assembly comprises a circumferential cradle 37 extending upwardly from the bottom centerline of the ca proximate the end of tank 3. The upper edges of bolster web 25 are also of arcuate construction such that the upper edges of the bolster plate mates with the outer surface of cradle 37 such that the bolster web 25 may be welded to cradle 37. Further, cradle assembly 35 comprises a cradle pad 39 which is formed of arcuate cross section, and which is welded to the bottom of the tank so as to extend inboard from the tank end toward the center of the car. Cradle pad 39 may, for example, be about one-half inch thick steel plate, and may have a width of about 36 inches. Typically, cradle 37 and cradle pad 39 are continuously welded to tank 3 about their entire perimeter, except in certain regions proximate the bolster assembly where insufficient space is present for complete welding. As indicated at 41, center stub sill 17 has a pair of vertically disposed spaced extensions which extend inboard from the outboard edge of cradle pad 39, with the upper edges of the sill extensions 41 welded to the bottom face of cradle pad 39.

It will be appreciated that upon applying longitudinal squeeze loads and resultant overturning moments to the center stub sill assembly 7, the relatively rigid stub center sill 17 tends to pivot or rotate relative to tank 3 about a horizontal axis generally at the location of bolster assembly 23 such that the inner ends of stub center sill extensions 41 apply a localized upward load on the cradle pad 39 and on tank 3. It has been found necessary to locally reinforce the prior art cradle pad 39 and tank 3 in the area of the inboard ends of sill extensions 41 by means of a cradle pad reinforcement plate 43.

As indicated at 45 in FIG. 2, it has been conventional to provide an outside serpentine steam coil system welded to the outer surfaces of tank 3 such that steam may be circulated through the steam coil system 45 thereby to heat the lading within the tank so as to aid in unloading of the lading. In an effort to heat the outer ends of the tank, it was conventional to provide steam coil openings 46 in the upper edge of bolster web 25 so that the various steam coils 47 could extend outboard beyond bolster web 25. However, it has been a long-standing problem as to how to extend the steam coils out beyond cradle 37, and as to how to effectively heat the bottom portion of the tank covered by cradle pad 39.

Referring now to FIGS. 3–17, the present invention will be hereinafter described in detail. As indicated at 7', a fabricated center stub sill assembly of the present invention is illustrated. In FIGS. 3–17, similar reference characters identify parts having a corresponding construction and function as the parts heretofore identified in the prior art railway car 1, as shown in FIGS. 1 and 2. Primed or double primed reference characters indicate parts having a similar construction and function, but modified in accordance with the present invention.

Figure 3:
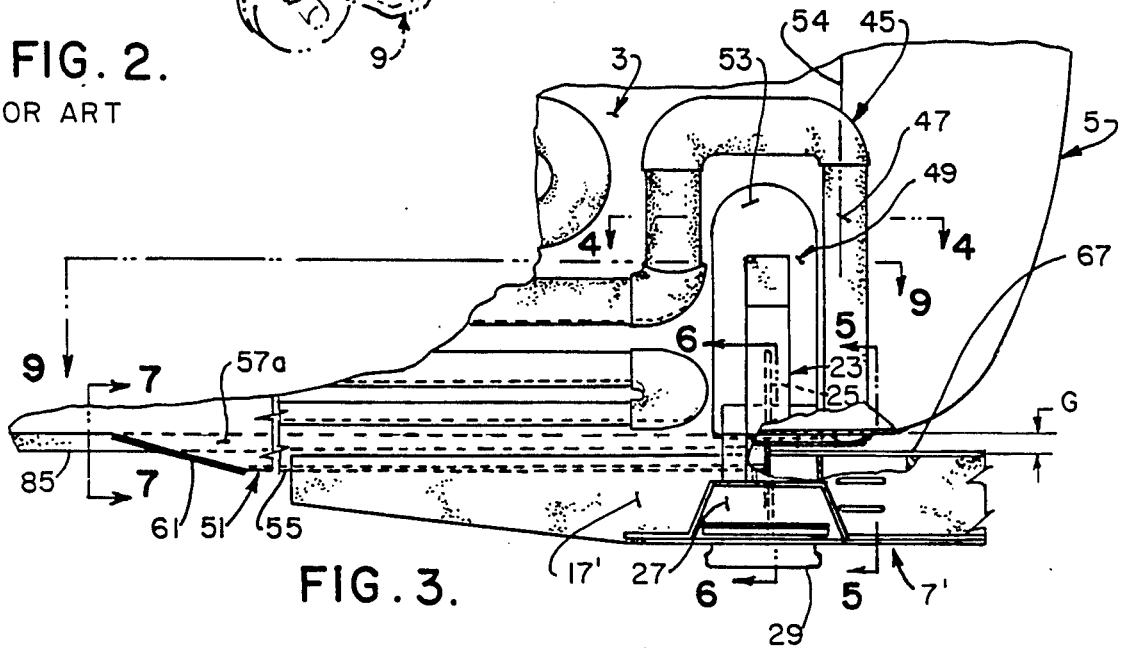
FIG. 3 is an enlarged partial side elevational view of the lower end of a railway tank car, illustrating a new cradle assembly of the present invention, and illustrating the manner in which a fabricated stub sill is attached to the cradle and to the bolster assembly, and further illustrating a half-oval coil steam manifold welded to the lower exterior portions of the railway tank car.

In accordance with this invention, a novel cradle assembly, as generally indicated at 49, is provided at each end of tank 3 for supporting the end of the tank on center stub sill assembly 7'. More specifically, cradle assembly 49 comprises an upwardly facing hat-shaped (channel-shaped) cradle pad, as indicated at 51, extending longitudinally along the bottom centerline of the car from the outboard end of tank 3 in inboard fashion toward the center of the car. Cradle assembly 49 further includes an arcuate cradle, as indicated at 53, generally in register with bolster web 25 of bolster assembly 23. In comparison with cradle 37 of cradle assembly 35, as shown on the prior art railway car 1 of FIG. 2, cradle 53, together with bolster assembly 23, is shifted outboard toward the weld seam 54 (as shown in FIG. 3) about five inches (12.7 cm.). This improves the reaction of coupler loads into the tank and allows at least certain of the steam coils 47 to heat substantially the entire length of tank 5 between cradles 53 without the necessity of the steam coils overlying the cradle pads, and without the necessity of the steam coils from passing through bolster web 25.

Figure 7:
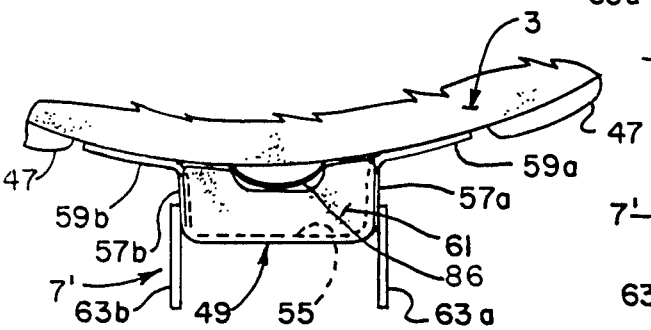
FIG. 7 is a vertical cross sectional view, taken along line 7—7 of FIG. 3, illustrating the bottom portion of the tank looking outboard and illustrating the end of a hat section cradle of the present invention and the manner in which the vertical flanges of the center stub sill are fixedly secured (welded) to the sides of the hot section-shaped cradle.
Figure 13:
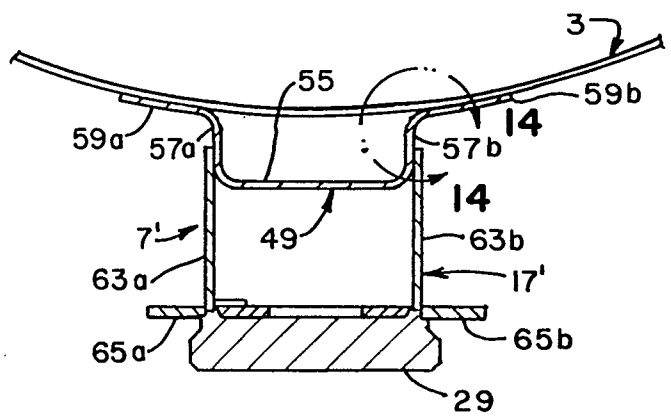
FIG. 13 is a vertical cross sectional view taken along line 13—13 of FIG. 10.

As best shown in FIGS. 7 and 13, cradle pad 51 is shown to be a one-piece hat section-shaped, elongate member, having a bottom horizontally extending cradle pad web 55 with upwardly extending cradle pad side flanges **57*a*, 57*b* extending upwardly from the cradle pad web. Cradle pad flange feet 59*a*, 59*b* extend outwardly from the cradle pad side flanges 57*a*, 57*b*, with the cradle pad flange feet conforming to the outer cylindric shape of tank 3. In this manner, cradle pad 51 may be readily welded to the bottom center portion of tank 3 by fillet welding side flange feet 59*a*, 59*b* to the tank. It will be appreciated that the cradle pad flange feet 59*a*, 59*b* may be readily bent relative to the cradle pad side flanges 57*a*, 57*b* so that the pad feet conform to the shape of the cylindric tank 3** so as to accommodate irregularities and distortions in the tank and so as to assure a flush fit of the pad feet on the tank.

Figure 15:
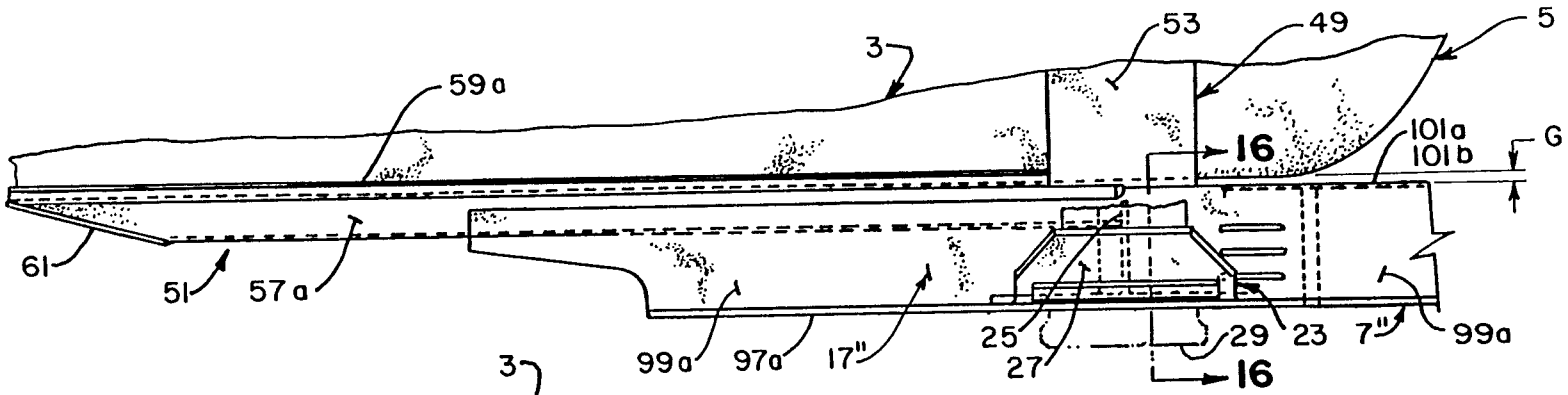
FIG. 15 is a view similar to FIG. 3, illustrating another embodiment of a center stub sill assembly made of rolled Z-sections secured to the cradle assembly of the present invention.
Figure 16:
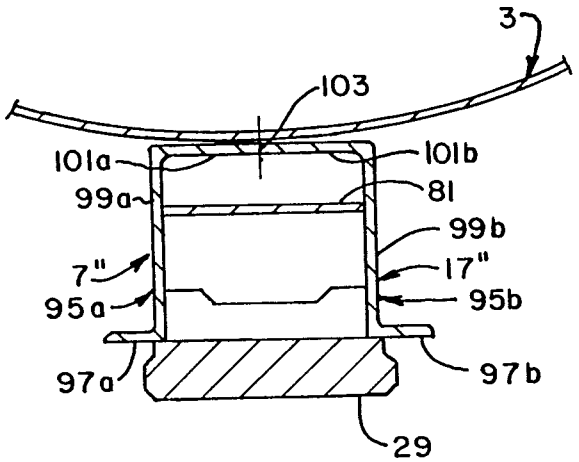
FIG. 16 a vertical cross sectional view taken along line 16—16 of FIG. 15 on a somewhat enlarged scale.

Stub sill 7′ of the present invention is shown to be a stub sill fabricated from a variety of steel plates. As will hereinafter be described with regard to the center stub sill 7″, as shown in FIGS. 15 and 16, center stub sill assembly 7″ is formed of two hot rolled Z sections, welded together at their tops along the longitudinal centerline of the stub sill assembly.

Figure 8:
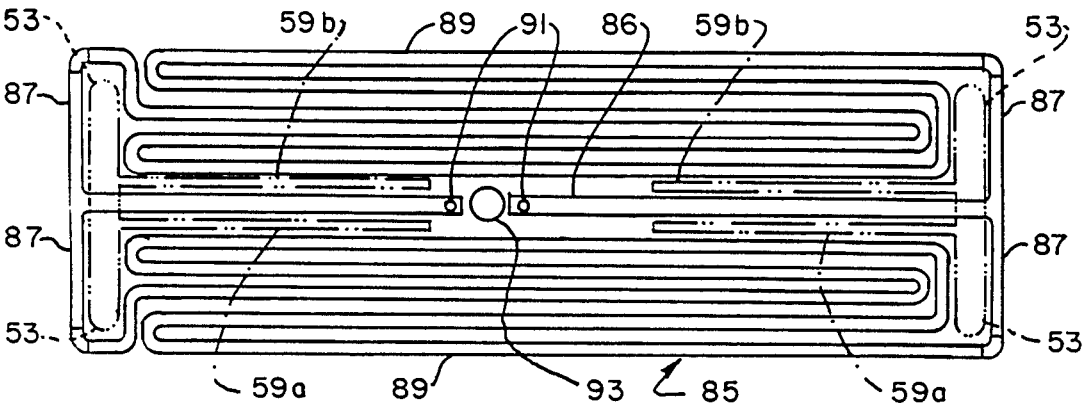
FIG. 8 a flat pattern layout of the serpentine steam coil assembly applied to the lower exterior portions of the tank in accordance with the present invention.
Figure 9:
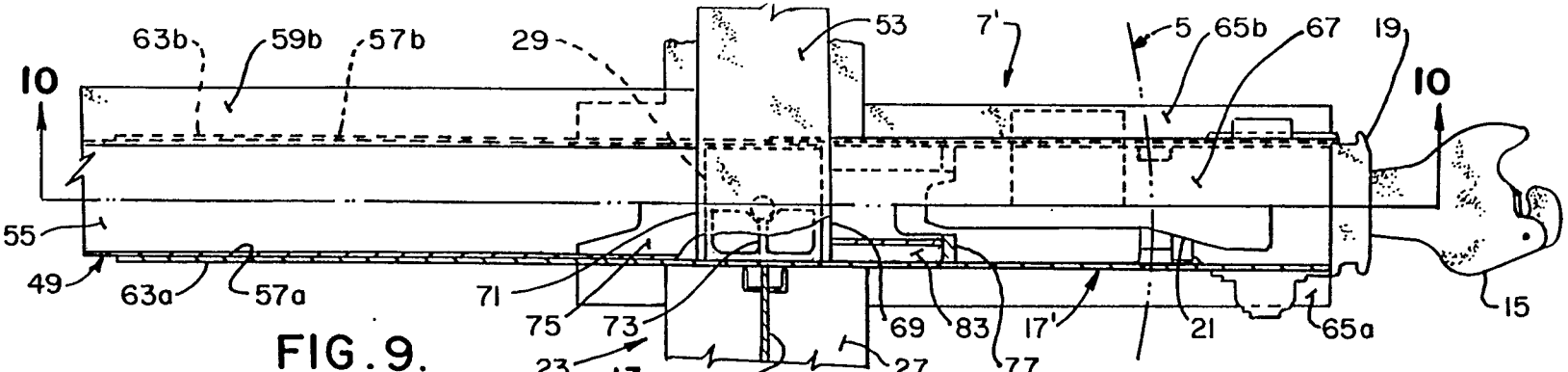
FIG. 9 is a horizontal cross sectional view taken along line 9—9 of FIG. 3 on a somewhat enlarged scale illustrating in top plan view the construction of the center stub sill assembly and cradle assembly of the present invention, with part of the center stub sill, cradle assembly, and bolster assembly shown in cross section for purposes of clarity.
Figure 10:
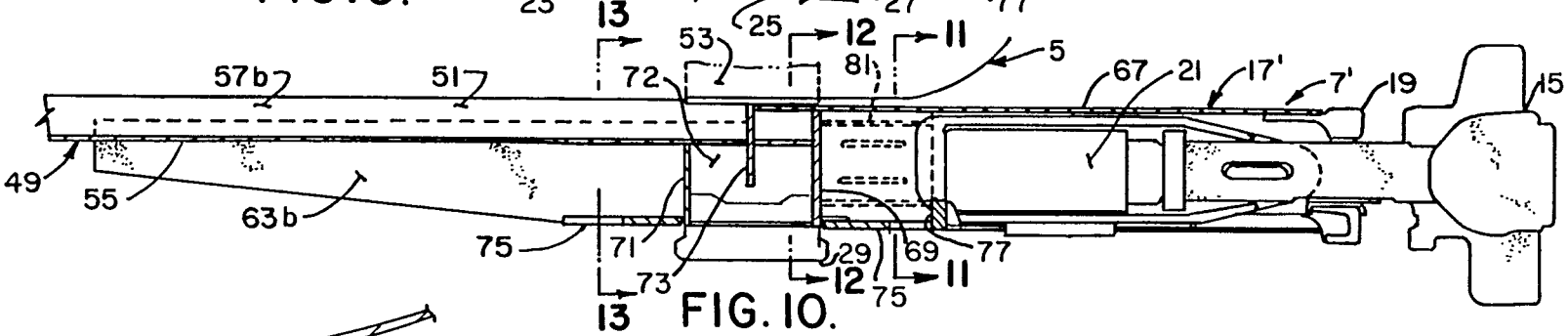
FIG. 10 a vertical cross sectional view taken along line 10—10 of FIG. 9.

More specifically, the fabricated center stub sill assembly 7′, as shown in FIGS. 3–14, has a pair of spaced, vertically disposed side flanges 63*a*, 63*b* with respective side flange feet 65*a*, 65*b* extending horizontally outwardly from the bottom edges of the side flanges outboard of the bolster assembly 23. This construction is most clearly illustrated in FIGS. 11–13. The fabricated center stub sill assembly 7′ further includes a top web 67 which spans between and is welded to the upper edges of side flanges 63*a*, 63*b* outboard of the bolster assembly 23 thereby to form a generally downwardly facing channel-shaped center sill member. As shown in FIGS. 9 and 10, center stub sill assembly 7′ extends outboard beyond bolster assembly 23 a sufficient distance so as to carry coupler 15. The downwardly facing channel-shaped opening defined by the center stub sill 7′ is of sufficient size so as to receive draft gear 21. Of course, the manner in which draft gear 21, coupler 15, and striker 19 are secured to center stub sill 7′ is substantially identical to the prior art center stub sills, and thus will not be described in detail.

As shown in FIGS. 9 and 10, outboard of the bolster web 25, an outboard spacer plate 69 is secured within center stub sill 7′ so as to extend transversely within the channel-shaped center stub sill. Similarly, an inboard spacer plate 71 extends between and is welded to side flanges 63*a*, 63*b* on the inboard side of the bolster web 25 so, as shown in FIG. 10, to define an opening 72, which receives the upper portion of body center plate 29. In this manner, the body center plate may be welded to side flanges 63*a*, 63*b* and to the bottom portions of the inboard and outboard spacer plates 69 and 71. Further, a center spacer plate 73 (see FIG. 10) is welded to the inboard end of top sill 67 to side flanges 63*a*, 63*b* of center stub sill 7′, and to the outboard and of the hat-shaped cradle pad 51 so as to be generally co-planar with bolster web 25 bridging opening 72. Bolster bottom cover 27 is welded to the lower margins of side flanges 63*a*, 63*b* of center stub sill 7′ and to the portions of tie plate 75 extending outwardly from the center stub sill 7′. Bolster web 25 is welded vertically on the outside of side flanges 63*a*, 63*b* generally in line with center spacer plate 73 and, of course, the upper margins of bolster web 25 conform to and are welded to the outer cylindric surface of tank 5.

Figure 11:
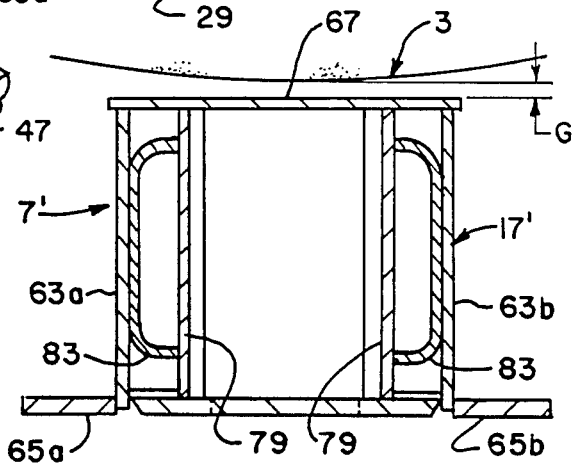
FIG. 11 vertical cross sectional view taken along line 11—11 of FIG. 10, on a somewhat enlarged scale, showing the parts of a fabricated center stub sill assembly outboard of the bolster assembly and inboard of the end of the draft gear illustrated in FIG. 10.

As shown in FIGS. 9 and 10, outboard from bolster assembly 23, a backstop 77 is provided within center stub sill 17′ so as to cooperate with draft gear 21 thereby to transmit inboard compression loads from the coupler 15 and draft gear 21 into center stub sill 17′. As shown in FIG. 11, additional backstop braces 79 extend vertically within stub center sill 17′ so as to reinforce backstops 77. As indicated at 81 (shown in dotted lines in FIG. 10), a cradle pad carry through plate is disposed horizontally within stub sill 17′ between backstops 77 and outboard spacer plate 69 disposed somewhat below top web 67 of stub center sill 17′. A longitudinally disposed, channel-shaped backstop reinforcement 83 also extends between backstop 77 and outboard spacer plate 69. In this manner, forces are transmitted between backstops 77 and the rigid structure disposed within stub center sill 17′ generally at the location of bolster assembly 23.

Figure 14:
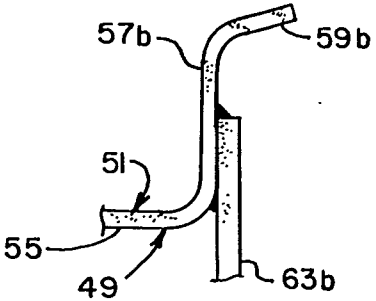
FIG. 14 an, enlarged view taken along line 14—14 of FIG. 13.
Figure 12:
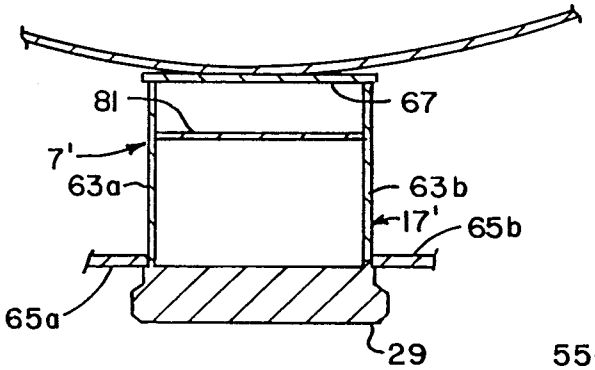
FIG. 12 is a vertical cross sectional view on a somewhat enlarged scale, along line 12—12 of FIG. 10.

Those skilled in the art will recognize that the improved cradle assembly 49 and the improved center stub sill assembly 7′ of the present invention facilitate securement of both the cradle assembly 49 to the tank 5 and facilitate securement of the center stub sill assembly to the cradle assembly. This is accomplished by the relative ease with which the hat shaped cradle pad 51 may be formed to match the tank-to-tank distortions and dimensional dissimilarities experienced in tank car manufacture. Further, the slip-fit connection of the side flanges (also referred to as sill extensions) 63*a*, 63*b* of center stub sill 17′ extending inboard from bolster assembly 23 such that the side flanges 63*a*, 63*b* are slidingly disposed on the outside faces of the cradle pad side flanges 57*a*, 57*b*, as best shown in FIGS. 13 and 14, permit the side flanges to be readily positioned and welded to the cradle pad. It will be understood that cradle assembly 49 may be secured (welded) to the bottom outboard portions of tank 5 by first welding cradle pad 53 to the outer cylindric portion of the tank in its desired position relative to weld line 54 between the tank end 5 and tank 3 (see FIG. 3). Then, the hat-shaped cradle pad 51 is applied to the bottom centerline of the car, with the outboard end of the cradle pad 51 generally in alignment with the axial position of bolster web 23 so that the outboard end of the cradle pad will abut against center spacer plate 73, as shown in FIG. 10. The cradle pad flange feet 59*a*, 59*b* may then readily be conformed (bent) to the cylindric shape of the tank with cradle pad web 55 centered with respect to the bottom longitudinal centerline of tank 3. The cradle pad 51 is then welded to the exterior of the tank, along the entire length of the outer edges of cradle pad flange feet 59*a*, 59*b*.

It will be noted in FIG. 13, for example, that the horizontally disposed cradle web 55 is spaced below the bottom centerline portion of tank 3 and that the cradle pad side flanges 57 extend vertically therefrom with the cradle pad flange feet 59*a*, 59*b* rigidly secured to the bottom portions of the tank. It will be appreciated that the hat-shaped cradle pad 51 thus attached to the bottom portion of tank 3 adds significantly to the local moment of inertia of the tank so as to increase the stiffness of the tank along the bottom longitudinal centerline thereof, as compared with a flat cradle pad plate 39 welded to the bottom of the tank, such as is illustrated in FIGS. 1 and 2 of prior art railway cars. The fact that the cradle pad feet 59*a*, 59*b* of the present invention are welded to the tank permits longitudinal loads to be distributed into the tank structure over a relatively long length, and the fact that the cradle pad feet 59*a*, 59*b* bear on a relatively large area of the tank locally stiffens the tank against buckling and obviates the need for scab reinforcement plates heretofore required to locally reinforce the tank walls against localized buckling. Also, end of weld loading patterns are essentially eliminated.

Importantly, the provision of the vertically disposed cradle pad side flanges 57*a*, 57*b* and the slip-fit of the stub center sill 17′ side flanges 63*a*, 63*b* on the outside of cradle pad side flanges 57*a*, 57*b* permit the distance between side flanges to be readily adjusted relative to the width of the hat section cradle pad 51 such that the side flanges 63*a*, 63*b* may be securely fitted on the outside of the cradle pad side flanges 57*a*, 57*b* in the manner illustrated in FIGS. 13 and 14. It will also be appreciated that, as shown in FIG. 14, it is a relatively easy matter to weld the stub center sill side flanges 63a, 63b in two places to the hat-shaped cradle pad 51, thus ensuring full weld lengths and maximum load carrying capability.

As contrasted with the connection of the prior art center stub sill extensions 41, which are welded to the bottom face of the longitudinal bottom cradle pad plate 39 (as shown in FIG. 2), it will be appreciated that the prior art stub center sill extensions are relatively stiff in vertical direction, and thus require substantial manufacturing effort so as to ensure that they uniformly contact the bottom surface of cradle pad 39 along their entire length thereby to enable proper welding of the side sill extensions to the cradle pad 39.

Figure 17:
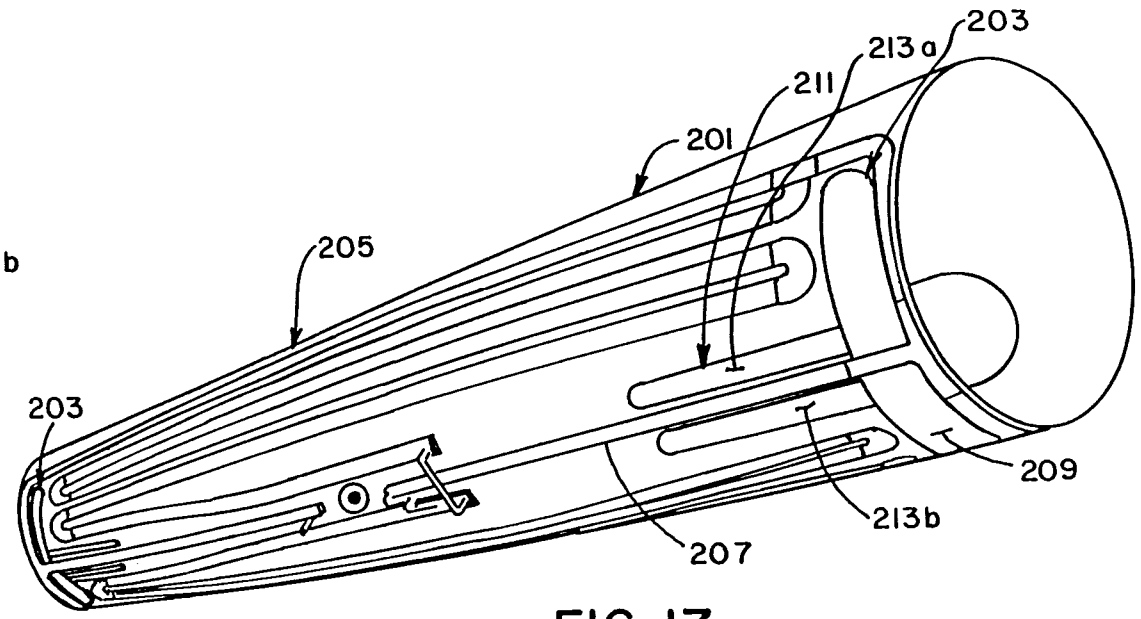
FIG. 17. PRIOR ART
FIG. 17 is a bottom perspective view of a tank of a prior art railway tank car, illustrating a serpentine manifolded half-oval outside coil system in which the cradle pad is split on opposite sides of the bottom centerline of the tank so as to permit a center steam line to be placed directly on the bottom centerline of the tank, except for the region of the circumferential cradle.

As shown in FIG. 3, the provision of a hat section-shaped cradle pad 51 of the present invention welded to the bottom centerline region of the tank 3 at both ends thereof facilitates the fabrication and securement of a serpentine exterior steam coil system 45 to the railway car 1 of the present invention. More specifically, as indicated at 85 (see FIG. 3), a steam line system may be secured (welded) to the exterior of tank 3 in direct heat transfer relation with the tank wall without the requirement of transferring heat through another layer of heavy metal, except in the area of cradle 53, and without the requirement of splitting the cradle pad, such as is shown in FIG. 17 (to be described hereinafter).

Still further in accordance with this invention, the outboard ends of tank 3 may be raised above the elevation of top web 67 of stub center sill 17' (as shown in FIGS. 3 and 15) a sufficient distance, as indicated by gap G, so as to permit a bottom center steam line 86 to extend outboard beyond the plane of bolster web 25, and beyond the outboard edge of cradle 53. At that point (i.e., on the bottom centerline of the tank above top sill 67), steam line 86 is "teed" into the respective half oval channel-shaped steam coils 87 which extends circumferentially of the tank. The circumferential coils 87 are in communication with a plurality of other steam lines 89 constituted by half-oval channels continuously welded to the outer cylindric surface of tank 3 in the pattern, as generally illustrated in FIG. 8. At the center portion of bottom center steam lines 85, conventional steam inlet/outlet fittings 91 are provided such that upon unloading a lading from railway tank car 1, the train attendant may connect a steam line to the steam coil system 85 of the present invention in the conventional manner such that live steam may be circulated through the steam coil system thereby to heat the lading within the tank car. Of course, excess waste steam and condensate may be removed from the steam line outlet 91 in the conventional manner. The tank car is further provided with a bottom outlet valve 93 in a manner well known to those skilled in the art. A detailed description of the steam inlet/outlet fittings 91 and the outlet valve 93, which do not, per se, constitute a part of this invention, is omitted for the sake of brevity.

Those skilled in the art will recognize that steam lines 85 form a so-called "duplex" steam heating system provided with two inlets and with the steam line from each of the inlets alternating with one another. In this manner, if one of the steam line sets is inoperable, the entire bottom surface area of the tank may still be heated by the other of the steam lines to permit unloading of the tank.

Referring now to FIGS. 15 and 16, still another embodiment of the tank car center stub sill assembly, as indicated in its entirety at 7'', is illustrated in which a center sill member 17'' of hot rolled steel construction is utilized in place of the fabricated stub sill 17' heretofore described in regard to FIGS. 3–14. As shown best in FIG. 16, center stub sill 17'' is comprised of two hot rolled structural steel Z-shaped members, as indicated at 95a, 95b, which have respective lower horizontal flanges 97a, 97b corresponding to side flange feet 65a, 65b of stub sill assembly 7'. Further, the Z sections 95a, 95b each have respective vertical side flanges or extensions 99a, 99b which correspond to vertical side flanges 63a, 63b. Each of the Z sections has an inwardly extending top horizontal flange 101a, 101b which are butt seam welded together, as indicated at 103, such that the upper horizontal flanges 101a, 101b correspond generally to top sill web 67 of fabricated stub sill 17'. As shown in FIG. 15, the top web formed by the butt seam welded upper horizontal flanges 101a, 101b is cut away in the portion of the stub sill 17' inboard of bolster web 25 of bolster assembly 23 such that side flanges 99a, 99b extend inboard of the car and are disposed on the outside faces of the cradle pad side flanges 57a, 57b. These sill side flanges 99a, 99b thus have a slip-fit with the hat shaped cradle pad 51, and are welded to the cradle pad side flanges 57a, 57b in the manner illustrated in FIG. 14.

Referring to FIG. 17, a bottom perspective view of a tank 201 of another prior art railway tank car is illustrated, with this tank having a cradle assembly 203 at each end thereof in the manner of cradle assembly 35 heretofore described in regard to prior art railway car 1, as shown in FIGS. 1 and 2. A serpentine half-oval steam coil system 205 is welded to the outer, bottom surface of the tank so as to extend lengthwise of the tank. The steam coil system includes a bottom center steam line 207 which runs lengthwise of the car along the bottom centerline thereof.

It will be noted that cradle assembly 203 comprises a circumferential cradle 209 and a split cradle pad 211 having cradle pad plates 213a, 213b welded to the bottom surface of the tank, with a space therebetween of sufficient width so as to permit bottom center steam line 207 to be welded in direct heat transfer relation with the outer cylindric surface of tank 201 in the space between cradle pad plates 213a, 213b. However, this prior art construction required the provision of two cradle pad plates 213a, 213b, which resulted in even more welding for attachment to the tank, and which did not significantly add to the local moment of inertia or stiffness of the bottom center portion of the tank.

In view of the above, it will be seen that the other objects of this invention are achieved and other advantageous results obtained.

As various changes could be made in the above constructions or method without departing from the scope of the invention, it is intended that all matter contained in the above description or shown in the accompanying drawing shall be interpreted as illustrative and not in a limiting sense.

What is claimed is:

1. In a stub sill railway tank car having a generally cylindric, elongate tank with a tank end at each end thereof, a center stub sill assembly secured to the lower portion of the tank at each end thereof for transferring longitudinal train loads and lading loads between the tank and the center stub sill assembly, each center stub sill assembly carrying a coupler and a truck assembly which is pivotally connected to the center stub sill assembly for rollingly supporting said railway car on the rails, said center stub sill assembly comprising a center stub sill secured to the bottom portion of said tank and extending inboard of the tank end but terminating short of the center of the tank and extending outboard beyond the end of the tank for carrying its respective said coupler, a bolster assembly secured to said center stub sill and extending transversely thereof proximate the connection of said truck assembly to said center stub sill assembly, and a cradle assembly secured to the lower end portion of said tank for reinforcing said tank bottom end portions and for transferring loads between said tank and said center stub sill assembly and said bolster assembly, wherein the improvement comprises: an improved cradle assembly having an arcuate cradle extending circumferentially upwardly form the bottom centerline of the tank somewhat inboard of the intersection between said tank and said tank end generally at the longitudinal position of said bolster assembly, and an elongate cradle pad secured to the bottom of said tank and extending in inboard direction along the bottom centerline of the tank, said cradle pad having a lower center web spaced below the bottom centerline of the tank, said center web having a thickness, and said cradle pad further having a pair of vertical flanges extending upwardly from said center web and being secured to said tank on opposite sides of the bottom centerline thereof, said center stub sill extending inboard form the coupler and having a pair of vertical sill flanges with said vertical sill flanges being disposed on the outer faces of said cradle pad vertical flanges inboard of said bolster assembly, said vertical sill flanges being in adjustable inside face-to-outside face slip fit engagement with said cradle pad vertical flanges thereby to facilitate adjustment between said center stub sill and said cradle pad through a range of adjustment substantially greater than said thickness of said center web to a desired adjusted position, and weld means for securing said center stub sill to said cradle pad when the latter are in their said adjusted position.

2. In a tank car as set forth in claim 1 wherein said cradle pad has feet extending outwardly from the upper end of each of said cradle pad vertical flanges, with said feet generally conforming to and being secured to said tank.

3. In a tank car as set forth in claim 1 wherein the inboard end of each of said cradle pads is closed by a plate welded thereto.

4. In a tank car as set forth in claim 1 wherein said center stub sill is a fabricated weldment having a pair of vertical, spaced plates constituting said vertical sill flanges, an upper horizontal plate welded to said spaced vertical plates constituting a horizontal sill web adjacent the bottom of the tank outboard of said bolster area, and said center stub sill having lower outward flaring flanges at the lower margins of said vertical sill flanges.

5. In a railway car as set forth in claim 1 wherein said center stub sill is of rolled construction comprising a pair of Z-shaped members, each having a vertically disposed side flange constituting one of said center stub sill flanges, and an upper inwardly extending flange with the inner edges of these last said inwardly extending upper flanges being welded together and constituting a horizontal sill web.

6. In a railway car as set forth in claim 1 further comprising a steam coil system in heat transfer relation with the outer surface of said tank, said steam coil system having a bottom steam line welded to the bottom centerline portion of said tank and extending axially of the tank within said cradle pad.

7. In a railway tank car as set forth in claim 6 wherein said center stub sill includes an upper horizontal sill web adjacent the bottom of the tank outboard of said bolster area, and wherein said tank is raised above said horizontal sill web generally at the location of said bolster assembly a predetermined distance such that said bottom steam line may extend outboard beyond said cradle pad in direct heat transfer relation with said cradle pad and said tank without interference with said horizontal sill web.

8. A cradle assembly for a railway car, the latter having an elongate body, a center stub sill at each end of the car, said cradle assembly being provided at each end of said body for reinforcement of the bottom end portions of said body and for securement of a respective center stub sill assembly to said body, said cradle assembly comprising a cradle extending upwardly from the bottom of said body proximate the outer end portion thereof, and a hat spaced cradle pad extending in inboard direction from said cradle, said hat shaped cradle pad having a horizontal center web spaced from said body and a pair of upwardly extending generally vertical side flanges secured to said body, said horizontal center web having a thickness, said hat shaped cradle pad being secured to the bottom center portion of said body on opposite sides of the bottom centerline thereof, said center stub sill comprising a pair of spaced vertical side flanges and a horizontal sill extending between the upper edges of said side flanges outboard of the mid-portion of said center stub sill assembly, with said side flanges extending inwardly toward the center of said body beyond the end of said horizontal center web, said center stub sill flanges being disposed on the outer faces of said hat shaped cradle pad vertical flanges so as to have a slip-fit therewith through a range of adjustment substantially greater than the thickness of said cradle pad horizontal center web and being welded thereto.

9. A cradle assembly as set forth in claim 8 wherein said hat shaped cradle pad cradle has feet extending outwardly from the upper ends of said vertical flanges, said feet generally conforming to and being secured to said body.

10. A cradle assembly as set forth in claim 9 wherein the inboard end of said hat shaped cradle pad is closed by a plate welded thereto.

11. In a stub sill railway tank car having a generally cylindric, elongate tank with a tank end at each end thereof, a center stub sill secured to the lower portion of the tank at each end thereof for transferring longitudinal train loads and lading loads between the tank and the center stub sill assembly, each center stub sill carrying a coupler and a truck assembly which is pivotally connected to the center stub sill assembly for rollingly supporting said railway car on the rails, each said center stub sill extending inboard of the tank end but terminating short of the center of the tank and extending outboard beyond the end of the tank for carrying its respective said coupler, a bolster assembly secured to said center stub sill and extending transversely thereof proximate the connection of said truck assembly to said center stub sill assembly, and a cradle assembly secured to the lower end portions of said tank for reinforcing said tank bottom end portions and for transferring loads between said tank and said center stub sill and said bolster assembly, wherein the improvement comprises: an improved cradle assembly having an arcuate cradle extending circumferentially upwardly from the bottom centerline of the tank somewhat inboard of the intersection between said tank and said tank end generally at the longitudinal position of said bolster assembly, and an elongate cradle pad secured to the bottom of said tank and extending in inboard direction along the bottom centerline of the tank, said cradle pad having a lower center web spaced below the bottom centerline of the tank, said center web having a thickness, and said cradle pad further having a pair of vertical flanges extending upwardly from said center web and being secured to said tank on opposite sides of the bottom centerline thereof, said center stub sill extending inboard from the coupler and having a pair of vertical sill flanges with said sill flanges being disposed on the outer faces of said cradle pad flanges inboard of said bolster assembly with a sill fit therebetween for adjustment between said center stub sill and said hat section cradle pad through a range of adjustment substantially greater than the thickness of said cradle pad center web such that with said center stub sill flanges in desired adjusted position with respect to said cradle pad, said sill flanges and said cradle pad may be rigidly welded together.

* * * * *

UNITED STATES PATENT AND TRADEMARK OFFICE

CERTIFICATE OF CORRECTION

PATENT NO. : 4,805,540

DATED : Feb. 21, 1989

INVENTOR(S) : James D. Mundloch, et al.

Figure 5:
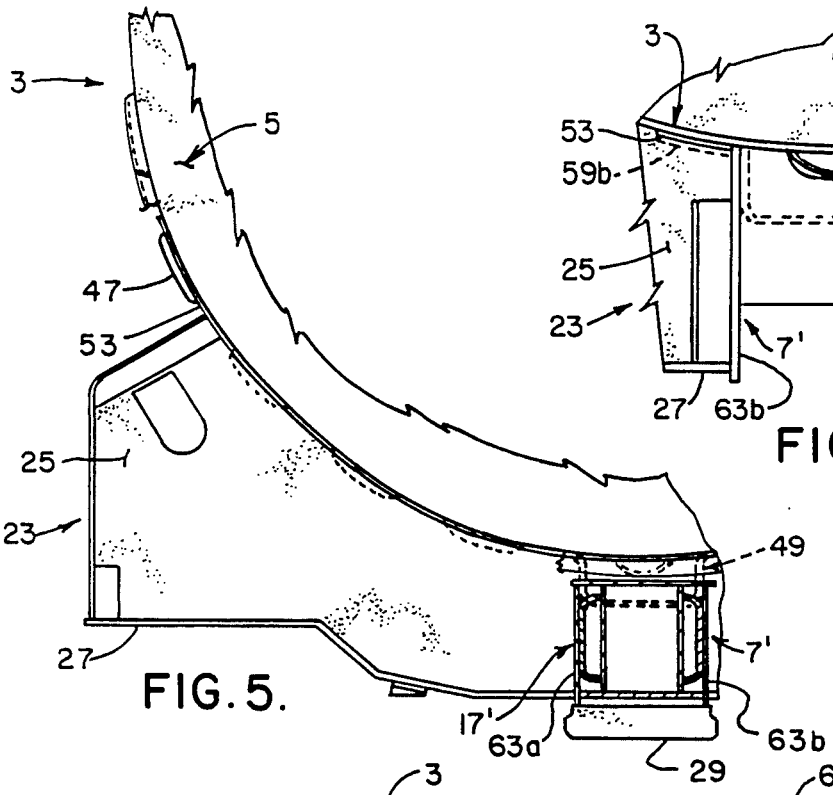
FIG. 5 vertical cross sectional view taken along line 5—5 of FIG. 3, illustrating the construction of the center stub sill assembly outboard of the bolster assembly, and illustrating the construction of the bolster assembly.
Figure 6:
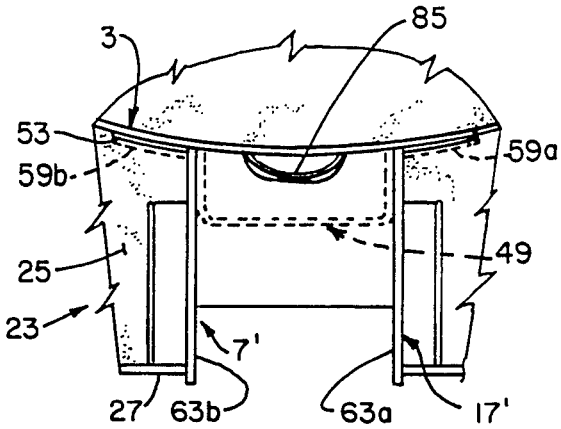
FIG. 6 is a vertical cross sectional view, taken along 6—6 of FIG. 3, on a somewhat enlarged scale relative to FIGS. 3 and 5, illustrating the construction of the center stub sill assembly immediately outboard of the bolster assembly web, with the center plate omitted for clarity.

It is certified that error appears in the above-identified patent and that said Letters Patent is hereby corrected as shown below:

On the title page, item [54] and in column 1, line 2, in the title, "STILL" should be --SILL--
Col. 1, line 7, "still" should be --sill--
Col. 5, line 34, "Fig. 1 a" should be --Fig. 1 is a--
Col. 5, line 53, "Fig. 5 vertical" should be --Fig. 5 is a vertical--
Col. 5, line 67, "the hot" should be --the hat--
Col. 6, line 11, "Fig. 10 a" should be --Fig. 10 is a--
Col. 6, line 13, "Fig. 11 vertical" should be --Fig. 11 is a vertical--
Col. 6, line 19, ", along line" should be --, taken along line--
Col. 6, line 22, "Fig. 14 an," should be --Fig. 14 is an--
Col. 6, line 28, "Fig. 16 a" should be --Fig. 16 is a--
Col. 7, line 42, "ca proximate" should be --car proximate--
Col. 13, line 15, "form" should be --from--
Col. 13, line 27, "form" should be --from--
Col. 14, line 21, "spaced" should be --shaped--
Col. 16, line 5, "sill" should be --slip--.

Signed and Sealed this

Twenty-sixth Day of December, 1989

*Attest:*

JEFFREY M. SAMUELS

*Attesting Officer* *Acting Commissioner of Patents and Trademarks*